US006526860B2

(12) United States Patent
Facciano et al.

(10) Patent No.: US 6,526,860 B2
(45) Date of Patent: Mar. 4, 2003

(54) COMPOSITE CONCENTRIC LAUNCH CANISTER

(75) Inventors: Andrew B. Facciano, Tucson, AZ (US); Craig R. Adams, San Diego, CA (US); Christine L. Benzie, Tucson, AZ (US); Kelvin M. Jordan, Tucson, AZ (US)

(73) Assignee: Raytheon Company, Lexington, MA (US)

( * ) Notice: Subject to any disclaimer, the term of this patent is extended or adjusted under 35 U.S.C. 154(b) by 0 days.

(21) Appl. No.: 09/884,721

(22) Filed: Jun. 19, 2001

(65) Prior Publication Data

US 2002/0189432 A1 Dec. 19, 2002

(51) Int. Cl.[7] ..... F41F 3/052

(52) U.S. Cl. ..... 89/1.801; 89/1.816; 89/1.819; 89/1.804

(58) Field of Search ..... 89/1.8, 1.801, 89/1.816, 1.817, 1.819, 1.804, 1.818

(56) References Cited

U.S. PATENT DOCUMENTS 4,137,351 A * 1/1979 Clodfelter et al. ..... 42/76.02
4,406,211 A * 9/1983 Andersen ..... 89/1.809
4,498,368 A * 2/1985 Doane ..... 220/89.2
4,556,438 A * 12/1985 Hoffmeister et al. ..... 156/173
4,646,618 A * 3/1987 Kurth et al. ..... 89/1.816
4,686,128 A * 8/1987 Gentilman ..... 244/121
5,058,481 A * 10/1991 Drummond et al. ..... 89/1.814
5,158,509 A * 10/1992 Ebaugh et al. ..... 102/517
5,220,125 A * 6/1993 Huber ..... 89/1.809
5,433,132 A * 7/1995 Hufault ..... 89/1.812
5,824,404 A 10/1998 Brown et al. ..... 428/301.4
5,837,919 A * 11/1998 Yagla et al. ..... 89/1.703
5,979,826 A 11/1999 Brown et al. ..... 244/121
6,230,604 B1 * 5/2001 Larson et al. ..... 89/1.812

* cited by examiner

*Primary Examiner*—Michael J. Carone
*Assistant Examiner*—Gabriel S. Sukman
(74) *Attorney, Agent, or Firm*—Colin M. Raufer; Leonard A. Alkov; Glenn H. Lenzen, Jr.

(57) ABSTRACT

A launch canister for a missile, including an outer canister shell and a concentric inner liner. The inner liner augments the canister shell with structural load capability and bending inertia to enhance canister stiffness. The inner liner can be constructed from structural load carrying composite materials, and also acts as a thermal and ablative insulator to enable vertical plume venting away from the enveloped missile. A shock and vibration isolation layer can be laminated between the inner liner and canister shell.

32 Claims, 3 Drawing Sheets

COMPOSITE CONCENTRIC LAUNCH CANISTER

TECHNICAL FIELD OF THE INVENTION

This invention relates to a canister structure for serving as a missile launch tube and/or shipping container.

BACKGROUND OF THE INVENTION

In the past, missile canisters have been too structurally compliant compared to the encased missile to properly protect the missile electronics and rocket motors from excessive shock upon transportation and deployment. The encased missile becomes the 'stiffening beam' reinforcing the canister verses the other way around, hence the primary shock loads are carried by the missile, not the canister. Numerous means of enabling metallic canisters to meet shock and vibration attenuation requirements have either required crushable endcaps for one time drop shock mitigation, and/or complex shipping container packaging schemes for vibration isolation.

SUMMARY OF THE DISCLOSURE

According to an aspect of the invention, a missile shipping and launch canister for housing a missile encased therein includes an outer canister shell structure. A plume impingement end plate structure is attached to the outer shell structure at a first end thereof. An inner liner is disposed within the outer shell structure, the inner liner sized to house and protect the encased missile from transportation and shipping environments during deployment. The inner liner includes guide surfaces for guiding the missile during launch egress while protecting deployable wings and control surfaces of the missile, and for thermally insulating the missile from a launch motor plume. The outer canister shell structure serves as a load-carrying structure that attaches the plume impingement end plate structure at the first end to form an integral plenum chamber, and attaches the cover to the second end to encase the missile.

BRIEF DESCRIPTION OF THE DRAWING

These and other features and advantages of the present invention will become more apparent from the following detailed description of an exemplary embodiment thereof, as illustrated in the accompanying drawings, in which.

DETAILED DESCRIPTION OF THE DISCLOSURE

Figure 1:
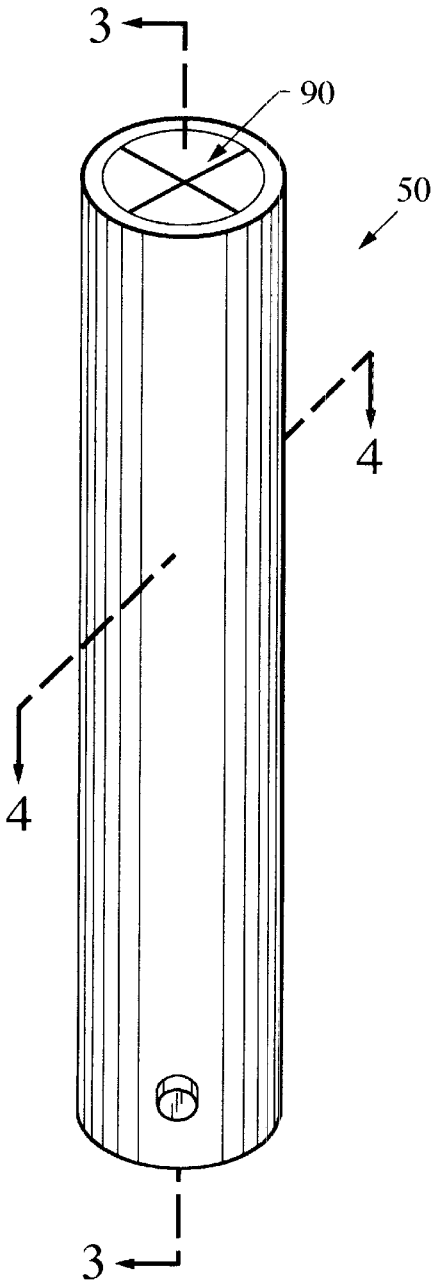
FIG. 1 is an isometric view of a missile launch canister embodying aspects of this invention.
Figure 2:
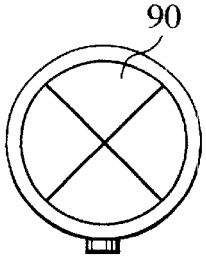
FIG. 2 is a top end view of the canister of FIG. 1.

A composite concentric launch canister (CCLC) in accordance with an aspect of the invention is a cylindrical missile canister structure designed to serve as both a missile launch tube and shipping container. In this embodiment, the CCLC is designed for vertical launched missiles that require self-contained, reversible rocket plume management or upward gas ejection as the missile egresses. The CCLC does not insert into a launch platform gas management or plenum network as does most common shipboard air defense systems; rather the CCLC incorporates a plume plenum chamber as a single shot launch canister designed to enable 'wooden round' deployment. After the missile is launched, the CCLC can simply be discarded and abandoned if necessary; hence the CCLC is relatively inexpensive and lightweight for rapid missile system deployment and utilization.

In an exemplary embodiment, the CCLC incorporates a composite concentric cylinder design, or integral tube within a tube configuration utilizing fiber reinforced, organic and inorganic resin materials. The inner cylinder or liner houses and protects the encased missile from transportation and shipping environments during deployment, guides the missile during launch egress while protecting the deployable wings and control surfaces, and thermally insulates the missile from the launch motor plume. The outer cylinder or canister shell is the primary load carrying the structure that attaches the plume impingement end plate, or hotplate assembly on the CCLC bottom to form the integral plenum chamber, while on top attaches the frangible cover, or fly through dome, to encase the missile. Passages are formed to allow rocket plume gases to escape upward during missile egress, and a shock isolation system can be included to attenuate transportation environments. The canister shell is designed to seal the encased missile from humidity, dust, and EMI (electromagnetic interference) during storage, as well as provide enough rigidity to be the primary load carrying structure for launch canister and shipping container functionality.

FIGS. 1–6 illustrate an exemplary embodiment 50 of the invention. The CCLC incorporates a composite concentric cylinder design, or integral tube-within-a-tube configuration utilizing fiber reinforced, organic and inorganic resin materials. An inner cylinder or liner 60 houses and protects the encased missile 20 (FIG. 3) from transportation and shipping environments during deployment, guides the missile during launch egress while protecting the deployable wings and control surfaces, and thermally insulates the missile from the launch motor plume. An outer cylinder or canister shell 70 is a primary load carrying structure that attaches the plume impingement end plate or hotplate assembly 80 on the CCLC bottom to form the integral plenum chamber 110 (FIG. 3), and on top attaches the frangible cover 90, or fly through dome, to encase the missile.

The cover 90 in an exemplary embodiment is fabricated of a composite or epoxy-urethane foam with molded grooves to weaken the cover for fragment disintegration during canister pressurization and missile launch.

The inner liner 60 defines passages 62A–62D which extend longitudinally along the extent of the liner to allow rocket plume gases to escape upwardly during missile egress. In this embodiment, the passages are molded into the inner liner 60. The canister shell 70 is designed to seal the encased missile from humidity, dust, and EMI (electromagnetic interference) during storage, as well as provide enough rigidity to be the primary load carrying structure for launch canister and shipping container functionality.

One important function of the inner liner 60 is to serve as guide rails during launch and to restrain the missile control surfaces and wings during storage. The inner liner 60 for this purpose defines a plurality of missile wing and fin channels 64A–64D, which are sized to surround the folded missile wings and fins 22.

Figure 5:
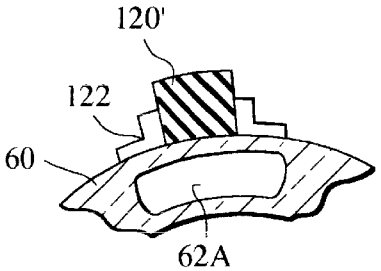
FIG. 5 illustrates an alternate form of shock isolation.

A shock isolation system 120 is provided between the inner liner 60 and the outer shell 70 to attenuate transportation environments and in the event of an air drop from fixed or rotary winged aircraft. In this exemplary embodiment, the shock isolation system 120 is a layer of low modulus, high temperature fluorosilicone elastomer, laminated between the inner liner 60 and canister shell 70 to enable shock and vibration isolation. The layer 120 can be assembled separately, or co-cured directly with the canister shell and inner linear composite structures for true integration. Alternatively, as shown in FIG. 5, discrete shock isolators 120' can be employed as spacers between the inner liner and outer shell 70, with attachment accomplished by ultrasonic welding of mounting brackets 120 (aluminum, steel or compression molded composite) to the ablative material or by precision placement prior to the molding operation.

To protect the shock isolator system 120 from damage by the plume, the inner liner 60 is formed from an ablative material such as discontinuous glass or carbon fiber phenolic composite, or discontinuous glass or continuous quartz polymetric silicone composite. Plume passages 62A–62D integral within the ablative material are molded and cured in place to allow for proper gas flow management during the missile firing. The canister assembly must also be capable of withstanding the complex gas flow, which occurs during the firing and exit of the missile. The plume passages ensure proper expulsion of the propellant during firing and exiting. In an exemplary embodiment, the composite inner liner 60 of the canister 50 is fabricated as a pultruded or compression molded, unidirectional glass or quartz fiber system impregnated with a pre-polymer ceramic, such as Cytec SM8000 marketed by Cytec-Fibente, Inc., 1440 N. Kraemer Boulevard, Anaheim, Calif. 92806. An alternate inner liner structure can be fabricated as an integrally weaved, glass-impregnated phenolic composite.

Figure 6:
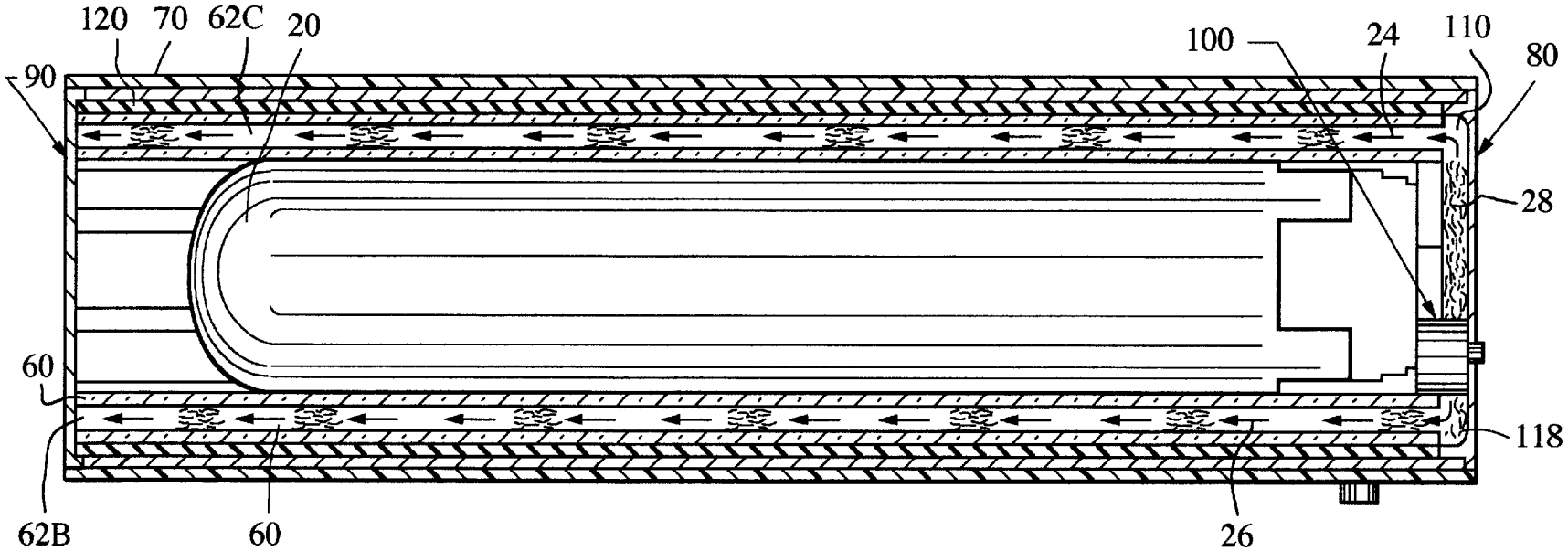
FIG. 6 is a cross-sectional view, taken along line 6—6 of FIG. 4.

FIG. 6 illustrates diagrammatically how the propellant gasses are expelled during firing and exiting of the missile 20 from the CCLC 50. The gasses generally indicated as 28 are expelled from the missile motor into plenum 110, and impinge on the end plate 80. The gasses are redirected by the end plate from the plenum 110 into the ends of the plume passages, which are in communication with the plenum. The gasses travel up the plume passages, e.g. passages 62C, 62B illustrated in FIG. 6, in the direction of arrows 24, 26 to the opposite end of the inner liner at the cover end of the canister 50, where the gasses exit the canister.

A thin aluminum shell 72 is provided as a structural concentric support for the outer filament wound surface of the canister shell 70. If discrete vibration isolators are employed as part of the shock isolation system, they can be riveted or otherwise attached to the vibration isolators prior to winding. This shell 72 can be quite thin, e.g. on the order of 0.005 inch to 0.010 inch. The aluminum shell also serves as a gas permeability and EMI barrier for the internally housed missile electronics in the missile 20.

The outer surface of the canister shell 70 in an exemplary embodiment is filament wound using an economical technique, such as wet wound graphite fiber epoxy or graphite fiber epoxy "towpreg." As is known to those skilled in the art, "towpreg" is an untwisted bundle of continuous filaments, commonly used to refer to man-made fibers, particularly carbon and graphite fibers, with multiple strands aligned in a uni-directional orientation within a "prepreg" tape. A "prepreg" tape is ready to mold or cure material in sheet form, which may be fiber cloth, or mat, impregnated with resin and stored for use. The resin is partially cured to a "B" stage and supplied to the fabricator for lay-up and use.

While filament winding is a preferred technique for forming the outer surface of the canister shell 70, other techniques can alternatively be employed. One exemplary suitable alternative is known as Resin Transfer Molding (RTM). This technique involves placing the fiber preform in a closed molded and injecting resin at low pressure, although for some applications a vacuum assist is appropriate. RTM processes are described, for example, in "High Rate Three Dimensional Near Net Shape Resin Transfer Molding," Gray Fowler and Michael Liggett, 45th Sampe Symposium, May 21–25 2000, Volume 45, Book 1, page 737.

The hotplate 80 is attached to the interior surface of the aluminum sheet metal cylinder by riveting and sanding flush the rivets prior to filament winding the mandrel for the shell 70. An alternate scheme of attaching the hotplate to the canister shell is to incorporate a 'trapped fiber', integrally wound joint, as described in "Filament Winding Composite Structure Fabrication," Society for the Advancement of Material and Process Engineering, January and October 1991, at pages 7–11 to 7–16. In this way the joint fails only if the canister fibers at the hotplate interface are physically severed, instead of relying solely on an adhesive interface.

An umbilical connector and latch assembly 100 integrated onto the hotplate or baseplate 80 orients the missile within the CCLC, as well as constrains it during transportation. Electrical communication between the missile and a computer and communication system (CCS) is achieved via an umbilical cable assembly 102 (FIG. 4), routed from the hotplate umbilical connector and latch assembly 100, through one of the plume passages, say plume passage 62B, to the guidance module of the missile 20.

Figure 7:
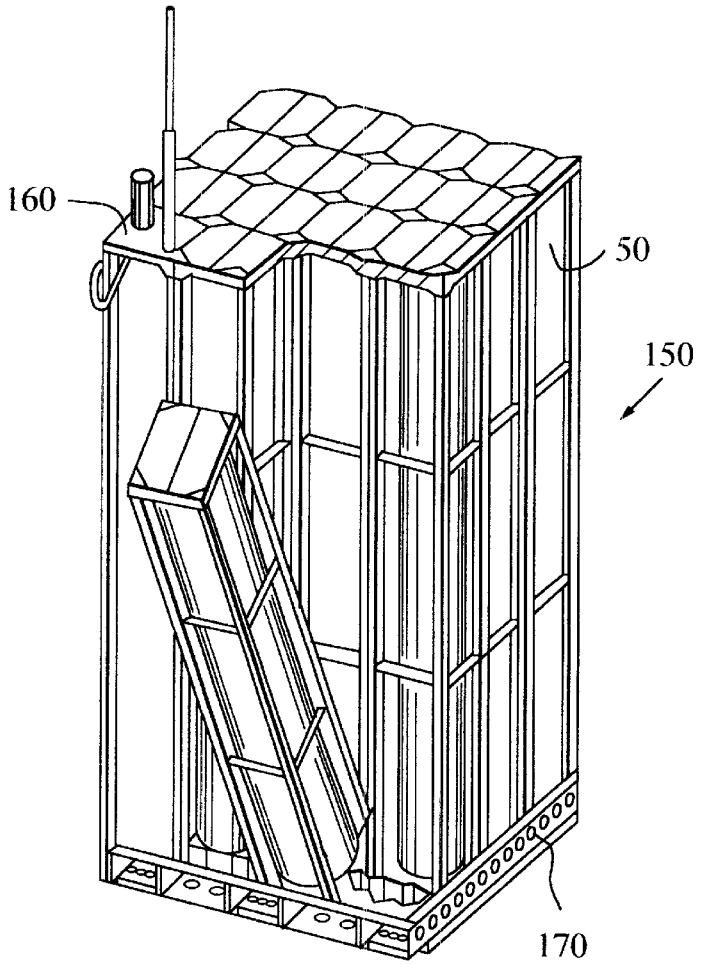
FIG. 7 is an isometric diagrammatic illustration of a pallet module of canisters with encased missiles.
Figure 3:
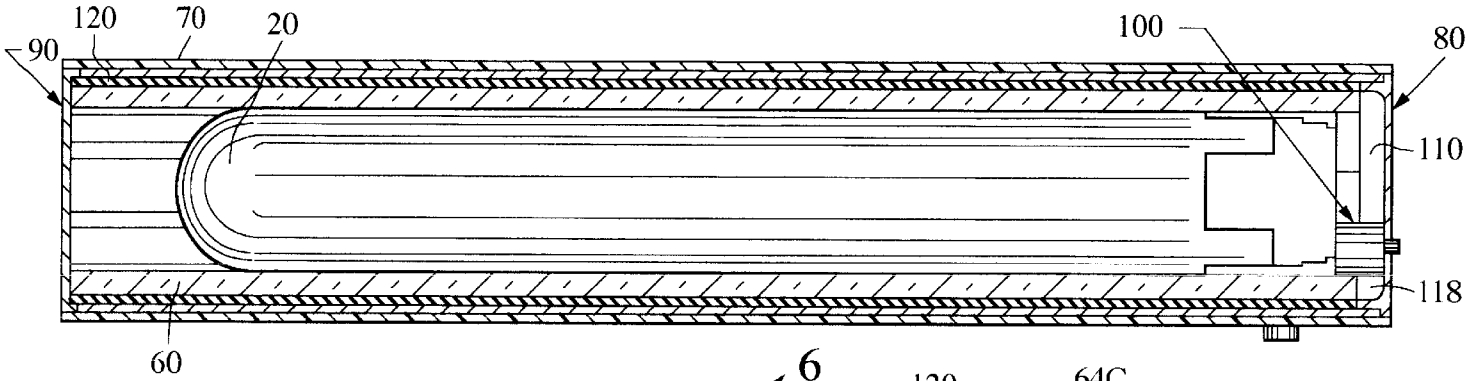
FIG. 3 is a cross-sectional view of the canister of FIG. 1, taken along line 3—3 of FIG. 1.
Figure 4:
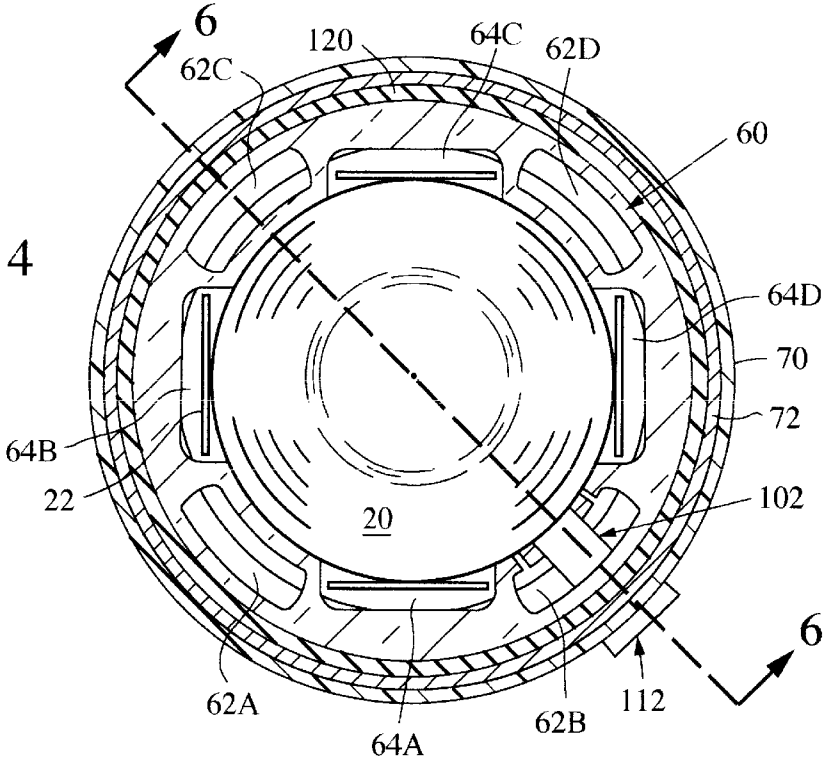
FIG. 4 is a cross-sectional view of the canister, taken along line 4—4 of FIG. 3.

FIG. 7 illustrates a container/launch unit 150 accommodating fifteen missiles each in a CCLC 50 as described above regarding FIGS. 1–6, where the forward corner CCLC is omitted for illustration, and a computer and communication system module 160, all mounted on a pallet 170. Each missile is capable of being fired individually, e.g. at a preset target.

While the CCLC has been illustrated with a cylindrical cross-section, other configurations can also be employed. For example, the CCLC can be configured with a generally rectangular cross-section, but with well rounded corners to still permit filament winding. This alternative embodiment with a larger volume can provide the capability of larger plume passages within the inner liner, since the passages could be aligned at the rounded corners. Moreover, the rectangular cross-section could allow a pallet as illustrated in FIG. 7 to be configured without a secondary rectangular frame structure as shown in FIG. 7.

The CCLC can provide advantages in addition to reduction of cost and weight with composite material processing and fabrication techniques. Integral CCLC features enable the canister to truly protect the encased missile by becoming stiffer than the missile itself, and by incorporating shock and vibration absorption materials, layer 120 in this embodiment, as part of the composite laminate composition. The single piece, inner liner 60 augments the canister shell 70 with both structural load capability and bending inertia to greatly enhance canister stiffness while forming the concentric canister feature. The inner liner can be constructed from structural load carrying composite materials, and in this case is also a thermal and ablative insulator to enable vertical plume venting away from the enveloped missile. Laminated between the inner liner 60 and canister shell 70 is the visco-elastic layer 120 to enable shock and vibration isolation that can be assembled separately, or co-cured directly with the canister shell and inner linear composite structures for true integration. No secondary endcaps or shipping packaging schemes are required with the CCLC, rather the shock and vibration attenuation features are preferably integral for increased protection of the encased missile at minimum cost.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A missile shipping and launch canister for housing a missile encased therein, comprising:

an outer canister shell structure;

a plume impingement end plate structure attached to the outer shell structure at a first end thereof;

an inner liner structure disposed within the outer shell structure, the inner liner sized to house and protect the encased missile from transportation and shipping environments during deployment, the inner liner structure including guide surfaces for guiding the missile during launch egress while protecting deployable wings and control surfaces of the missile, and for thermally insulating the missile from a launch motor plume, the inner liner structure having defined therein a plurality of plume passages to allow rocket plume gases to escape upward during missile egress while preventing the gases from impinging against an inner surface of the outer shell structure;

the outer canister shell structure serving as a primary load-carrying structure that attaches the plume impingement end plate structure at said first end to form an integral plenum chamber.

2. The canister of claim 1, wherein the outer canister shell structure has a generally rectangular cross-sectional configuration.

3. The canister of claim 1, wherein the outer shell structure comprises an outer filament wound structure.

4. The canister of claim 2, wherein the outer shell structure includes a metal shell structure to provide electromagnetic interference shielding.

5. The canister of claim 4, wherein the metal shell structure is a metal liner within the outer canister shell structure.

6. The canister of claim 1, wherein the plurality of plume passages are in communication with the plenum chamber.

7. The canister of claim 1 wherein the inner liner structure is fabricated of an ablative material to withstand effects of hot gasses.

8. The canister of claim 7 wherein said ablative material comprises discontinuous glass or carbon fiber phenolic composite.

9. The canister of claim 7 wherein said ablative material comprises a pultruded or compression molded unidirectional glass or quartz fiber system impregnated with a pre-polymer ceramic.

10. The canister of claim 7 wherein said ablative material comprises an integrally weaved, glass-impregnated phenolic composite.

11. The canister of claim 7 wherein said ablative material comprises a discontinuous glass or continuous quartz polymetric silicone composite.

12. The canister of claim 1, further comprising a shock isolation system disposed between the outer shell structure and the inner liner structure.

13. The canister of claim 12, wherein the shock isolation system comprises an elastomeric layer.

14. The canister of claim 1 further comprising a fly-through cover structure attached to a second end of the outer shell structure.

15. The canister of claim 1, wherein the outer canister shell structure and the inner liner structure have a concentric cylindrical configuration.

16. A canister for housing a missile, comprising:

an outer canister shell structure;

a plume impingement end plate structure attached to the outer shell structure at a first end thereof;

an inner liner structure disposed within the outer shell structure, the inner liner sized to house and protect the encased missile from transportation and shipping environments during deployment, the inner liner structure including guide surfaces for guiding the missile during launch egress, and a plurality of internal plume passages to allow rocket plume gases to escape during missile egress while shielding inner surface regions of the outer shell structure from contact with the gases;

the outer canister shell structure serving as a primary load-carrying structure, the plume impingement end plate structure attached at said first end of said outer canister shell to form an integral plenum chamber.

17. The canister of claim 16, wherein the outer shell structure comprises an outer filament wound structure.

18. The canister of claim 17, wherein the outer shell includes a metal shell structure to provide electromagnetic interference shielding.

19. The canister of claim 16, wherein the plurality of plume passages are in communication with the plenum chamber.

20. The canister of claim 16, wherein the inner liner is fabricated of an ablative material to withstand effects of hot gasses.

21. The canister of claim 16, further comprising a shock isolation system disposed between the outer shell and the inner liner.

22. The canister of claim 21, wherein the shock isolation system comprises an elastomeric layer.

23. The canister of claim 16, further comprising a cover structure attached to a second end of the outer shell structure.

24. The canister of claim 16, wherein the outer canister shell structure and the inner liner structure have a concentric cylindrical configuration.

25. The canister of claim 16, wherein the outer canister shell structure has a generally rectangular cross-sectional configuration.

26. A missile shipping and launch canister for housing a missile encased therein, comprising:

an outer canister shell structure fabricated of composite materials;

a plume impingement end plate structure attached to the outer shell structure at a first end thereof;

an inner liner structure disposed within the outer shell structure, the inner liner sized to house and protect the encased missile from transportation and shipping environments during deployment, the inner liner structure including guide surfaces for guiding the missile during launch egress while protecting deployable wings and control surfaces of the missile, and for thermally insulating the missile from a launch motor plume, the inner liner structure having defined therein a plurality of plume passages to allow rocket plume gases to escape upward during missile egress while preventing the gases from impinging against an inner surface of the outer shell structure, the inner liner structure fabricated of an ablative material to withstand effects of hot gasses;

the outer canister shell structure serving as a primary load-carrying structure that attaches the plume impingement end plate structure at said first end to form an integral plenum chamber.

27. The canister of claim 26, wherein the outer shell structure comprises an outer filament wound structure.

28. The canister of claim 26 wherein said ablative material comprises discontinuous glass or carbon fiber phenolic composite.

29. The canister of claim 26 wherein said ablative material comprises a pultruded or compression molded unidirectional glass or quartz fiber system impregnated with a pre-polymer ceramic.

30. The canister of claim 26 wherein said ablative material comprises an integrally weaved, glass-impregnated phenolic composite.

31. The canister of claim 26 wherein said ablative material comprises a discontinuous glass or continuous quartz polymetric silicone composite.

32. The canister of claim 26, further comprising a shock isolation system disposed between the outer shell structure and the inner liner structure.

* * * * *